US010208521B2

(12) United States Patent
Zimmer et al.

(10) Patent No.: US 10,208,521 B2
(45) Date of Patent: Feb. 19, 2019

(54) ACTUATOR OF A COMBINED ACCELERATION AND DECELERATION ARRANGEMENT

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 208 days.

(21) Appl. No.: 15/072,024

(22) Filed: Mar. 16, 2016

(65) Prior Publication Data

US 2016/0281407 A1 Sep. 29, 2016

(30) Foreign Application Priority Data

Mar. 17, 2015 (DE) ..... 10 2015 003 427

(51) Int. Cl.

| | |
|---|---|
| ***E05F 5/02*** | (2006.01) |
| ***E05F 15/00*** | (2015.01) |
| ***E05F 5/00*** | (2017.01) |
| ***E05F 1/16*** | (2006.01) |
| ***E05D 15/06*** | (2006.01) |

(52) U.S. Cl.

CPC ..... *E05F 15/00* (2013.01); *E05D 15/0621* (2013.01); *E05F 1/16* (2013.01); *E05F 5/003* (2013.01); *E05F 5/027* (2013.01); *E05Y 2201/21* (2013.01); *E05Y 2201/264* (2013.01); *E05Y 2600/12* (2013.01); *E05Y 2600/46* (2013.01); *E05Y 2600/626* (2013.01); *E05Y 2800/24* (2013.01); *E05Y 2900/132* (2013.01)

(58) Field of Classification Search

CPC ... E05F 1/16; E05F 11/00; E05F 5/003; E05F 5/027; E05F 15/00; E06B 3/44; E05Y 2600/626; E05Y 2201/21; E05Y 2201/264; E05Y 2800/24; E05Y 2900/132; Y10T 16/629; Y10T 16/628; Y10T 16/6285; Y10T 16/61

See application file for complete search history.

(56) References Cited

U.S. PATENT DOCUMENTS

| | | | | |
|---|---|---|---|---|
| 6,487,752 | B1 * | 12/2002 | Mathews | E05F 5/003 16/86 A |
| 7,028,370 | B2 * | 4/2006 | Hoshide | E05F 1/16 16/90 |
| 9,708,844 | B2 * | 7/2017 | Glogowski | E05F 5/003 |
| 9,834,972 | B2 * | 12/2017 | Xu | E05F 5/003 |

(Continued)

FOREIGN PATENT DOCUMENTS

| | | |
|---|---|---|
| CN | 000202 467441 U | 2/2012 |
| WO | 214/109771 A1 | 4/2014 |

*Primary Examiner* — Victor D Batson
*Assistant Examiner* — Matthew J Sullivan
(74) *Attorney, Agent, or Firm* — Klaus J. Bach

(57) ABSTRACT

In an actuator of a combined acceleration and deceleration device with an operating element which is height-adjustable along a guide element and, by means of an adjustment arrangement, relative to the guide element, the operating element comprises a support plate and at least one carrier lug which extends normal to the support plate and has a guide element accommodation opening for receiving the guide element. The adjustment arrangement has a tool receiving cavity and the support plate has elastically deformable abutment webs. The invention also resides in a sliding door comprising an acceleration and deceleration device as well as such an actuator.

9 Claims, 2 Drawing Sheets

(56) References Cited

U.S. PATENT DOCUMENTS

| | | | | |
|---|---|---|---|---|
| 9,863,177 | B2 * | 1/2018 | Zimmer | E05D 15/0652 |
| 2016/0281407 | A1 * | 9/2016 | Zimmer | E05F 5/003 |
| 2016/0340917 | A1 * | 11/2016 | Zimmer | E05F 5/003 |

* cited by examiner

ACTUATOR OF A COMBINED ACCELERATION AND DECELERATION ARRANGEMENT

BACKGROUND OF THE INVENTION

The invention concerns an actuator of a combined acceleration and deceleration arrangement with an actuating element which is height adjustable and which comprises a support plate and at least one carrier lug extending normal to the support plate, and also a sliding door arrangement with such an actuator.

CN 202 467 441 U discloses such an actuator. However, during the adjustment of the actuating element relative to the guide element the two components can cant one another.

It is the principal object of the present invention to provide an actuator which can be adjusted without problems.

SUMMARY OF THE INVENTION

In an actuator of a combined acceleration and deceleration device with an operating element which is height-adjustable along a guide element and, by means of an adjustment arrangement, relative to the guide element, the operating element comprises a support plate and at least one carrier lug which extends normal to the support plate and has a guide element accommodation opening for receiving the guide element. The adjustment arrangement has a tool receiving cavity and the support plate has elastically deformable abutment webs. The invention also resides in a sliding door comprising an acceleration and deceleration device as well as such an actuator.

The invention will become more readily apparent from the following description of exemplary embodiments.

DESCRIPTION OF EXEMPLARY EMBODIMENT

Figure 1:
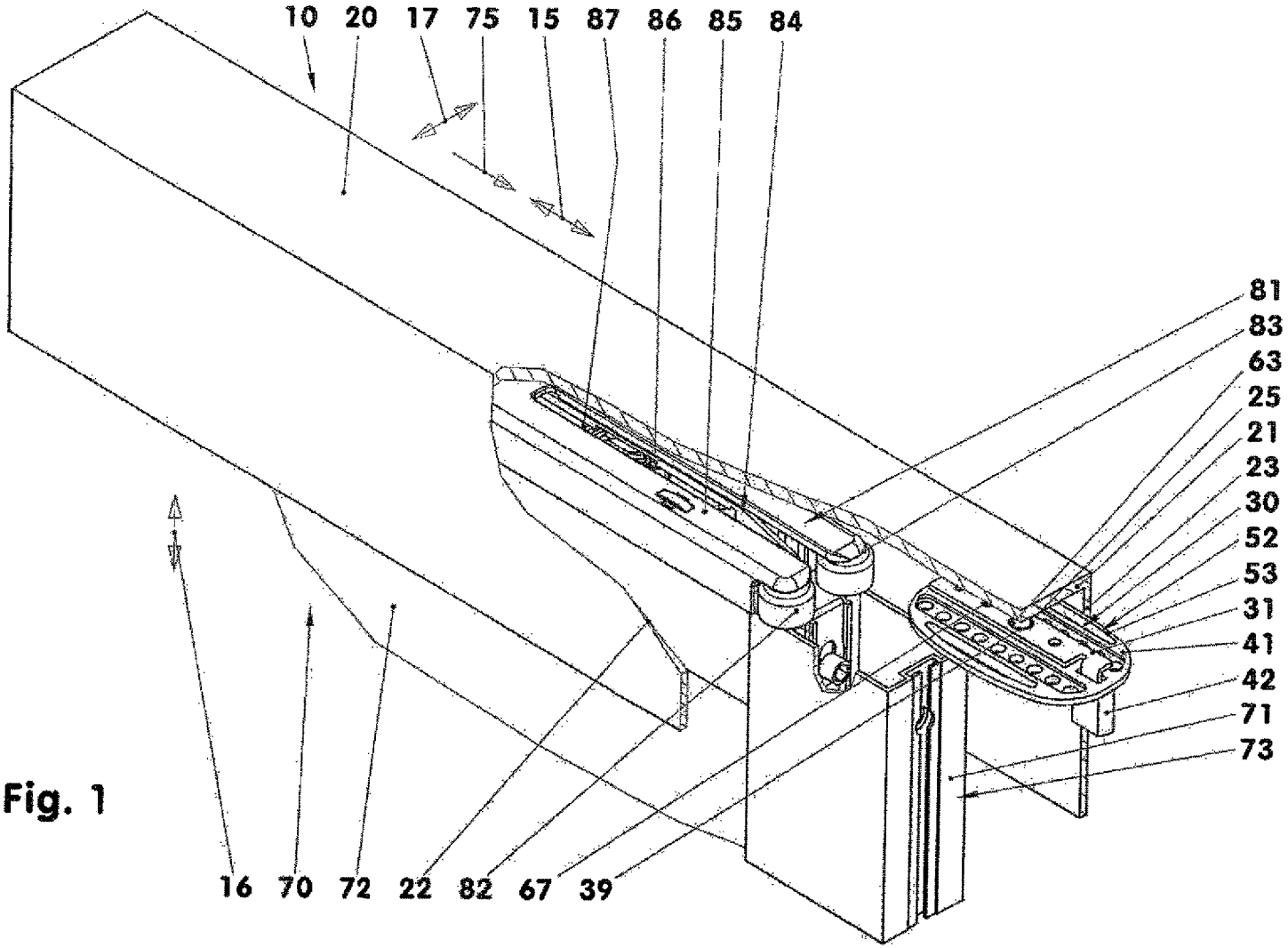
FIG. 1: A sliding door arrangement with an actuator and an acceleration and deceleration arrangement.

FIG. 1 shows a sliding door arrangement 10. The sliding door arrangement 10 comprises for example an upper door guide track 20 arranged on a door frame member in which a sliding door 70 is slidably supported so as to be movable between a closed and an open position. The sliding door 70 may be operated manually or by a motor. At its lower end, the sliding door 70 is provided for example with a support roller running in a guide track.

The door guide track 20 is U-shaped. It has a horizontal support web 21, which, when installed, extends on the top. Two downwardly extending guide webs 22, 23 are parallel to each other. In this door guide track 20, which is manufactured for example by a continuous casting process, the support web 21 and the guide webs 22, 23 form a guide space in which the sliding door 70 is guided.

The sliding door 70 comprises a support frame which consists for example of several parts and which carries a sliding door panel 72. The sliding door panel 72 may consist for example of wood, metal, plastic, etc. The sliding door panel 72 may also be hollow.

On the door frame 71, a door fitting 81 is mounted. This door fitting 81 comprises in the exemplary embodiment two transverse guide rollers 82, 83 by which the sliding door 70 can be guided along the guide webs 22, 23 of the door guide track 20. Between the two transverse guide rollers 82, 83, the door fitting 81 has an introduction opening 84. The introduction opening 84 which is open on top and toward the door front end 73 has, normal to the longitudinal direction 15 which coincides with the longitudinal direction of the sliding door 70, a rectangular cross-section.

Into the introduction opening 84 extends a carrier element 86 of a combined acceleration and deceleration device 87. The carrier element 86 is movable between a force- and/or form-locking secure park position and an end position. For example, upon closing the sliding door 70, the carrier element 86 comes into contact with an actuator 36 which is arranged in the door guide track 20 and is coupled to the actuator 36 before it reaches the closed end position. The actuator 30 releases the carrier element 86 from the park position.

During movement out of the park position toward the end position, the carrier element 86 and, together therewith, the sliding door 70 are pulled toward the end position by an energy store which is being discharged while, at the same time, they are slowed down by a deceleration arrangement comprising a cylinder piston unit. The superimposition of the two forces results in a braking of the sliding door 70 until it comes to a shock-free rest in its closed end position.

The acceleration and deceleration device 87 may also be provided at the end area of the sliding door 70 which faces in the opening direction which is opposite the closing direction 75. In this case, for example, the opening movement is slowed. It is also feasible to arrange such door fittings 81 at both ends of the door. Also, the upper acceleration and deceleration device 87 can cooperate with an additional acceleration and deceleration device which is arranged at the bottom end of the door.

The actuator 30 is mounted to the support web 21 of the door guide track 20. It comprises a guide element 31 and an operating element 41 which is adjustable relative to the guide element 31 by means of an adjustment arrangement 61. The operating arrangement 41 comprises two downwardly extending carrier projection 42. At least one of these carrier projections 42 can be coupled to the carrier element 86 of the acceleration and deceleration device 87.

Figure 2:
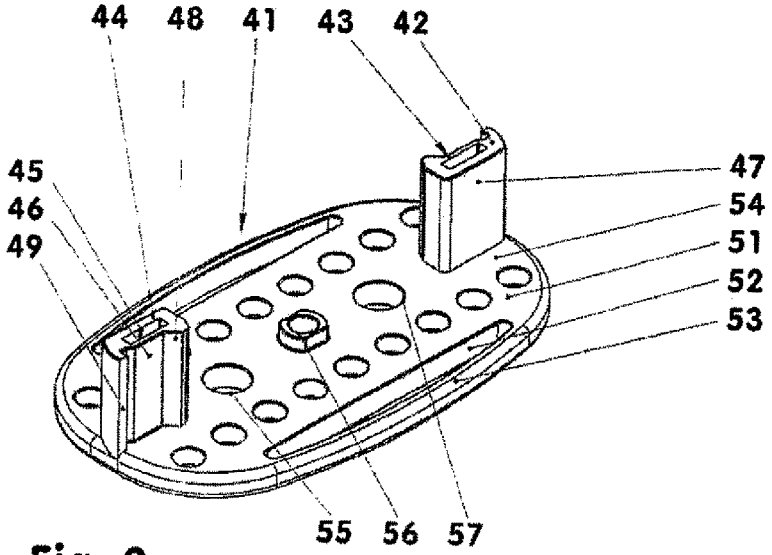
FIG. 2: an operating element.
Figure 4:
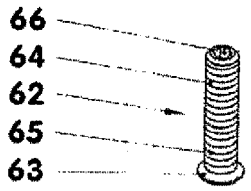
FIG. 4: an adjustment element.
Figure 3:
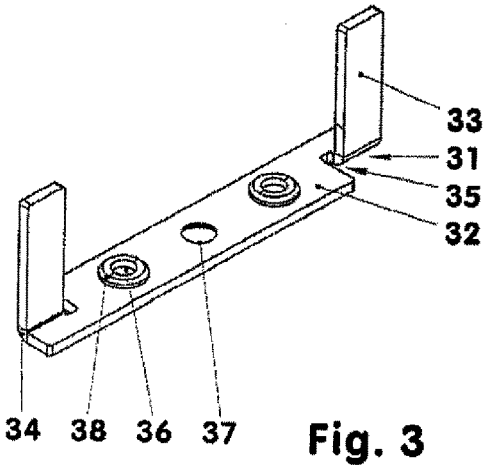
FIG. 3: a guide element.

FIGS. 2-4 show components of the actuator 30. The operating element 41 shown in FIG. 2 consists of a support plate 51 of for example an elliptical configuration and two carrier lugs 42 projecting from the support plate 51. The carrier lugs 42 are arranged in the vertical longitudinal center plane of the operating element 41. As shown, the operating element 41 is symmetrical with respect to a straight line which extends normal to the longitudinal direction 15 and normal to the transverse direction 17 of the operating element 41. The operating element 41 may also be provided only with a single carrier lug 42. The operating element 41 consists for example of a thermoplastics material.

The support plate 51 is provided in the in the side areas longitudinal slots 52 which are spaced in the transverse direction 17. In the transverse direction 17 of the support plate 51, these longitudinal slots 52 are delimited in each case by an abutment web 53. At least the abutment webs 53 which are in the form of ellipsoidal curved abutment webs 53 are elastically deformable. The abutment webs 53 extend to the longitudinally oriented carrier lug areas 54 of the support plate 51. The abutment webs 53 may also be in the form of cantilevered webs. Then they are attached in each case one-sided to a lug area 54.

The individual carrier lug 42 has a central guide accommodation opening 43 which extends through the carrier lug 42 in vertical direction 16 with a constant cross-sectional area. The at-least approximately rectangular cross-sectional area has at a longitudinal side 44 thereof a clamping web 45 which extends into the guide accommodation opening 43.

Also, the outer contour of the carrier lug 42 delimits in vertical direction a constant cross-sectionals surface area. This outer contour has a carrier area 46 and a planar side area 47 facing away from the carrier area 46. The carrier area 46 comprises in the exemplary embodiment a carrier web 48 and a stop web 49 which, during coupling, extend in a form-locking manner around the carrier element 86. The carrier areas 46 and the side areas 47 of the two carrier lugs 42 are facing away from each other.

Between the two carrier lugs 42, the support plate 51 has two cylindrical openings 55, 57 between which a threaded sleeve 56 is arranged which extends through, and is connected to, the support plate 51. All of the openings 51-57 are arranged along a longitudinal center line and extend normal to the support plate 51. The threaded sleeve 56 which may also be in the form of a nut is arranged in the exemplary embodiment co-axial with the axis of symmetry.

FIG. 3 shows the guide element 31. It comprises a mounting plate 32 and two guide members 33. In the exemplary embodiment, the guide element consists of an aluminum sheet with a constant thickness of for example two millimeters. The guide members 33 are bent out of the plane of the mounting plate 32. Both guide members 33 have the same length and extend parallel in the same direction. Also, the guide element 31 is symmetrical with respect to a straight line which extends normal to the longitudinal direction 15 and normal to the transverse direction 17 of the guide element 31. Next to the bent area 34 in each case a clearance 35 is provided in the mounting plate 32.

Between the guide member 33, two threaded bores 36 and a throughbore 37 are arranged. The two outer threaded bores 36 are provided with reinforcements 38 at their bottom side facing in the direction of the guide members 33. The center throughbore 37 is provided at the top side of the mounting plate 32 with a countersink area 39.

FIG. 4 shows an adjustment element 62, which is a screw with a planar head 61 whose diameter is for example 1.4 times the diameter of the shaft 64. The cylindrical shaft 64 is provided with a thread 65. At the front face of the shaft 64, a hexagonal recess 66 is punched into the shaft for receiving a socket wrench.

For the assembly of the actuator 30, the guide members 33 of the guide element 31 are inserted into the guide member accommodation openings 43 of the operating element 41. From the top, then, the adjustment element 62 is inserted through the throughbore 37 and screwed into the threaded bore 56.

Figure 5:
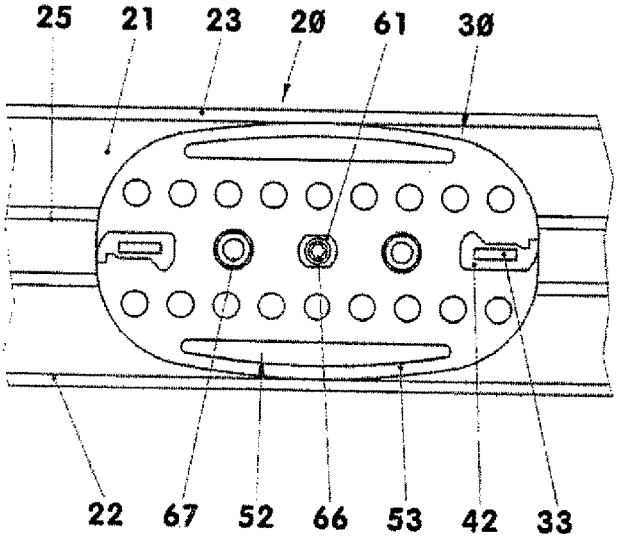
FIG. 5: a door guide track with actuator.

During the mounting of the door guide track 20, the guide element 31 can be moved into an engagement guide structure 25 of the door guide track 20. During the movement into the door guide track 20, the actuator 30 is for example held in position by the actuating element 41. The abutment webs 53 are compressed so that the actuator 30 can easily slide between the guide webs 22, 23. When the operating element 41 is then released, the abutment webs 53 resume elastically their shape and engage the longitudinal guide webs 22, 23. The actuator 30 is now attached to the door guide track 20 in a force-locking manner, see FIG. 5. When the actuator 30 is positioned for example by means of a template in the door guide track 20, it is fixed in place. To this end, for example, two clamping screws 67 are threaded through the openings 55, 57 of the operating element 41 into the threaded bores 36. With the tightening of the clamping screws 67, the mounting plate 32 is fixed in the engagement guide structure 25 in a force-locking manner. But installation can also be performed in another working order.

After placement of the sliding door 70 with the upper door fitting 81 into the door guide track 20, the height of the actuator 81 can be adapted to door fitting 81. To this end, the adjustment arrangement 61 is operated. By means of a hexagonal socket wrench, the adjustment screw 62 which abuts the support web 21 is so adjusted that the carrier lugs 42 of the carrier element 86 just completely overlay the carrier element 86. The sliding door arrangement 10 is now ready for operation.

In place of a force-locking fixing of the guide element 31 in the door guide track 20, the guide element 31 may also be fixed to the door guide track 20 by cementing or screwing. The actuator 30 may then be installed in the door guide track 20 for example also normally with respect to the support web 21.

During closing of the sliding door 70, the carrier element 86 for example contacts the stationary actuator 30. The carrier lug 4 facing the carrier element 86 is loaded thereby. Because of the central force application, only little bending forces are effective on the actuator 30. The sliding door 70 is decelerated in a controlled manner until it comes to a standstill in the closed end position.

The actuator 30 described herein can be used for sliding doors 70 closing toward a right-side end position as well as for a left-side end position.

Also combinations of the various exemplary embodiments are possible.

| Reference Number List: | |
|---|---|
| 10 | Sliding door arrangement |
| 15 | Longitudinal direction |
| 16 | Vertical direction |
| 17 | Transverse direction |
| 20 | Door guide track |
| 21 | Support web |
| 22 | Guide web |
| 23 | Guide web |
| 25 | Guide structure |
| 30 | Actuator |
| 31 | Guide element |
| 32 | Mounting plate |
| 33 | Guide member |
| 34 | Bent area |
| 35 | Clearance |
| 36 | Threaded bores |
| 37 | Throughbore |
| 38 | Reinforcement |
| 39 | Countersink |
| 41 | Operating element |
| 42 | Carrier lugs |
| 43 | Guide accommodation opening |
| 44 | Longitudinal side wall |
| 45 | Clamping web |
| 46 | Carrier area |
| 47 | Side area |
| 48 | Carrier web |
| 49 | Stop web |
| 51 | Support plate |
| 52 | Longitudinal slots |
| 53 | Abutment web |
| 54 | Lug areas |
| 55 | Opening |

-continued

| Reference Number List: | |
|---|---|
| 56 | Threaded sleeve |
| 57 | Opening |
| 61 | Adjustment arrangement |
| 62 | Adjustment element, adjustment screw |
| 63 | Head |
| 64 | Shaft |
| 65 | Thread |
| 66 | Hexagonal cavity |
| 67 | Clamping screws |
| 70 | Sliding door |
| 71 | Support frame |
| 72 | Sliding door panel |
| 73 | Door front end |
| 75 | Closing direction |
| 81 | Door fitting |
| 82 | Guide roller |
| 83 | Guide roller |
| 84 | Receiver opening |
| 85 | Top side |
| 86 | Carrier element |
| 87 | Acceleration and deceleration device |

What is claimed is:

1. An actuator (30) of a combined acceleration and deceleration device (87) with an operating element (41) which is height adjustable along a guide element (31) and, by an adjustment arrangement (61), relative to the guide element (30), the operating element (41) comprising a support plate (51) and at least one carrier lug (42) extending normal to the support plate (51), wherein:

the carrier lug (42) has a guide element accommodation opening (43) for receiving a guide member (33) of the guide element (31), the adjustment arrangement (61) has a tool receiving cavity (66) facing away from the guide element (31) and the support plate (31) has abutment webs (53) which are elastic and extend along the outside of the carrier plate (51).

2. The actuator (30) according to claim 1, wherein the abutment webs (53) have in an undeformed state at least approximately the shape of an outwardly curved ellipse section.

3. The actuator (30) according to claim 1, wherein the support plate (51) includes a threaded sleeve (56) for receiving an adjustment element (62) of the adjustment arrangement (61).

4. The actuator (30) according to claim 1, wherein said actuator (30) comprises two carrier lugs (42) and two guide members (33).

5. The actuator (30) according to claim 4, wherein at least the operating element (41) and the guide element 931) are oriented symmetrically with regard to an axis of symmetry which extends normal to the longitudinal direction (15) and normal to the transverse direction (17).

6. The actuator (30) according to claim 1, wherein the guide element (31) has at least two threaded bores (36) with which openings (55, 57) formed in the operating element (41) are in alignment.

7. The actuator (30) according to claim 1, wherein the operating element (41) consists of an elastic material.

8. A sliding door arrangement (10) including an acceleration and deceleration device (87) and an actuator (30) according to claim 1.

9. The sliding door arrangement (10) according to claim 8, wherein the actuator (30) is mounted in a U-shaped door guide track (20) which comprises longitudinal guide webs (22, 23) wherein the abutment webs (53) are engaged with the longitudinal guide webs (22, 23) in a force-locking manner.

* * * * *